United States Patent [19]

Begley et al.

[11] Patent Number: 4,856,780

[45] Date of Patent: Aug. 15, 1989

[54] SPORTS TRIVIA BOARD GAME

[75] Inventors: Samuel E. Begley; Lana H. Begley, both of London, Ky.

[73] Assignee: Chipnjay, Inc., London, Ky.

[21] Appl. No.: 172,784

[22] Filed: Mar. 28, 1988

[51] Int. Cl.[4] ..... A63F 3/00

[52] U.S. Cl. ..... 273/244

[58] Field of Search ..... 273/244, 249, 243

[56] References Cited

U.S. PATENT DOCUMENTS 4,216,594 8/1980 Farley et al. ..... 273/249

FOREIGN PATENT DOCUMENTS 2573666 5/1986 France ..... 273/244

*Primary Examiner*—Edward M. Coven
*Assistant Examiner*—Benjamin Layno
*Attorney, Agent, or Firm*—King and Schickli

[57] ABSTRACT

A game is provided for testing a player's knowledge of basketball trivia. The game includes a playing board having a plurality of color playing spaces. Five differently colored pairs of tokens are provided, the first token being used to track the player's progress around the board and the second being used to keep score on a scoreboard section provided in the center of the playing board. During play, each player advances his token according to the roll of a pair of dice. Depending on the square landed upon the player may earn one point "free throws" and two and three point "field goals" for answering a question from a set of question cards. Each card includes several questions of increasing difficulty. A plurality of colored cubes corresponding to the colored spaces are provided. These colored cubes further have indicia corresponding to the questions on each question card. The question the player must answer is determimined by first landing on a colored space, then rolling the correspondingly colored cube. The indicia appearing on the cube corresponds to the question to be asked on the question card. By landing on the spaces so marked, the player can commit fouls, turnovers, be sent to the bench, or the like just like in a real basketball game.

12 Claims, 1 Drawing Sheet

SPORTS TRIVIA BOARD GAME

TECHNICAL FIELD

The present invention relates generally to games and gaming apparatus, and more particularly, to a sports trivia board game which tests a player's knowledge and simulates real sports play.

BACKGROUND OF THE INVENTION

Board games are a very popular form of recreation. In recent years, specialized board games testing a player's knowledge of trivia have become increasingly popular. A very popular game in use today is marketed under the trademark "Trivial Pursuit" by Selchow and Righter Company. This game tests a player's trivia knowledge in several subject areas. In play, the player moves a token a number of spaces corresponding to the roll of a die. The player must answer a trivia question in the subject area indicated on the space on which the player's token lands. The playing spaces are arranged such that the player may move his token in one of several directions, thereby allowing the player a choice of questions to answer.

Similarly, U.S. Pat. No. 4,557,485 to Lardon discloses a board game for testing a player's knowledge. In this game, the player advances a token around a game board. The player must answer a question, the subject matter and difficulty of which is determined by the space upon which the player's token lands.

U.S. Pat. No. 4,000,897 to York discloses a game board apparatus for instructing spelling. The game board layout and the play of the game generally follows a baseball game.

A need is identified for an instructional or trivia oriented game which tests a player's sports knowledge within the framework of a game situation simulating a real life game.

SUMMARY OF THE INVENTION

It is therefore an object of the present invention to provide a sports trivia question and answer game to test a player's knowledge.

Another object of the present invention is to provide a novel sports trivia board game which is challenging and exciting to play.

Still another object of the present invention is to provide a basketball trivia game which tests a player's knowledge of basketball trivia within the context of a game which conforms to the rules and elements of a conventional game of basketball, thereby closely approximating real play.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a sports trivia board game is provided to test a player's knowledge of sports trivia.

The preferred embodiment of the sports trivia board game selected to illustrate the invention comprises a game which tests a player's knowledge of basketball trivia within the context of the rules of basketball, thereby approximating real life play. The present invention includes a board having playing squares defining a continuous playing path. As will be described in more detail, each square has indicia printed thereon to instruct the player landing on the square. This indicia corresponds to situations encountered in basketball games such as scoring opportunities, penalties, turnovers and the like.

To begin play, each player is assigned a pair of tokens. In the preferred embodiment, five differently colored pairs of tokens are provided, thereby allowing up to five players or teams to play at a time. One token is utilized to mark a player's advancement around the board, the other is used to keep score.

During play, a pair of dice is used as a random number generator to determine the number of squares a player may advance. Play proceeds around the board in a clockwise direction, all players beginning from the "bench".

During play, each player proceeds in turn. The player rolls a pair of dice and advances his/her token a number of squares corresponding to the number shown on either die. Some of the squares are scoring squares and instruct the player as to the level of difficulty of a question to be answered and the number of points received for a correct answer. Other squares are penalty squares and instruct the player to return to the bench for example. A deck of cards having questions and answers is provided to test the player's knowledge.

As in a real basketball game, a player may by correctly answering the question set forth score a one point "free throw" and two and three point "field goals". The number of points awarded for a correct answer is indicated on the square.

Each question and answer card contains five trivia questions of increasing difficulty. Upon landing on a scoring space, the player throws a question cube which corresponds to the square. Use of this cube determines by chance the level of difficulty of the question to be answered.

In the preferred embodiment, the five questions are designated by letters A–E, the level of difficulty ascending alphabetically. These five questions are sub-divided into three difficulty ranges corresponding to the one, two and three point scoring opportunities. The easy range includes questions A, B and C. The intermediate range includes questions B, C and D. The difficult range includes questions C, D and E. Landing on a one point scoring space, for example, entitles the player to answer a question from the easy range, the exact question A, B or C is determined by the throw of the question cube. The choice of question from the intermediate and difficult ranges proceeds similarly. Each question cube additionally contains one "turnover" or penalty side. If this side is rolled, the game "turns over" to the next player, the first player loses her turn.

As described earlier, the game board includes several penalty squares interspersed among the scoring squares. By landing upon these penalty squares, the player "commits" fouls, turnovers or be obliged to return to the bench just as in regular basketball play.

Play proceeds until a player has reached 30 points. Each player keeps score with his second token on a scoring section provided in the center of the board.

As it can been seen, the board game of the present invention advantageously combines a player's knowledge of sports trivia with elements of chance thereby creating interesting and exciting play. The game proceeds much like a regular basketball game, the players can score one, two or three points for correctly answering a question. The players can also commit fouls and be sent to the bench, just like in a regular game.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and becoming a part of the specification, illustrates several aspects of the present invention and together with the description serves to explain the principals of the invention. In the drawing.

Reference will now be made in detail to the present preferred embodiment of the invention, an example of which is illustrated in the accompanying drawings.

DETAILED DESCRIPTION OF THE INVENTION

Figure 1:
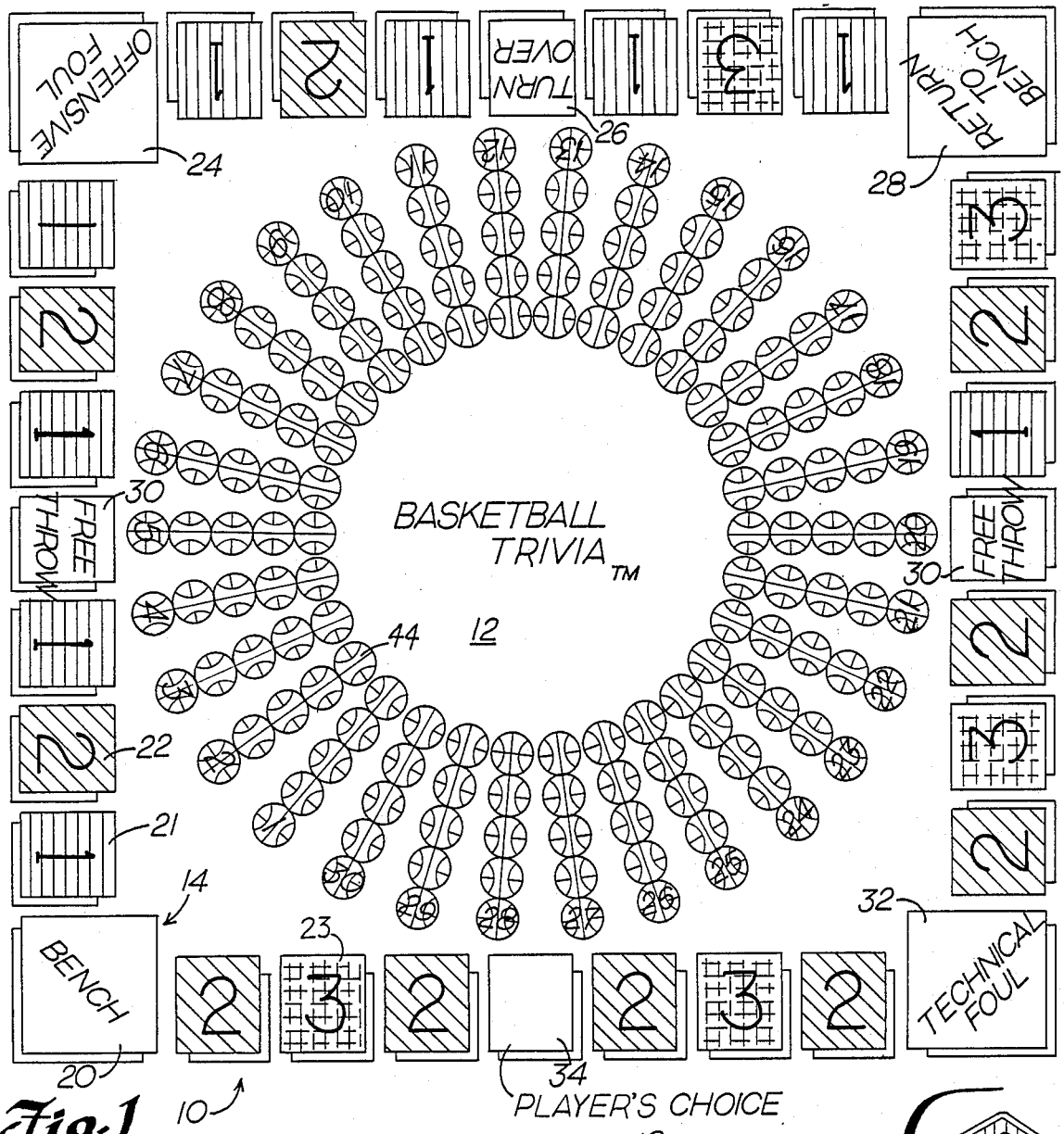
FIG. 1 is a plan view of game board of the preferred embodiment of the present invention.

Reference is now directed to FIG. 1 illustrating the sports trivia board game 10 of the present invention. The preferred embodiment selected to illustrate the present invention is a basketball trivia board game. The object of the game is to score points (make baskets) by correctly answering various trivia questions related to the game of basketball. As will be described in more detail below, play follows the rules and practices of real basketball, thereby adding an element of realism and enjoyment to the game.

The game 10 includes a playing board 12. As is known in the art, the board 12 can be hinged or otherwise adapted to be folded thereby facilitating easy, compact storage. As is shown in FIG. 1, the playing board 12 includes a plurality of playing squares 14 arranged so as to provide a continuous playing path. Each square 14 has instructional indicia printed thereon to direct the player, the nature and importance of which will be described below.

Figure 2:
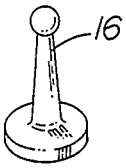
FIG. 2 is a perspective view of a token used in the present invention.
Figure 4:
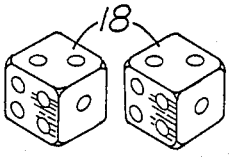
FIG. 4 is a perspective view of a standard pair of dice as used in the present invention.

During play, the player advances a token 16 (as shown in FIG. 2) a number of playing squares as determined by the throw of a pair of dice 18. The dice 18 are standard gaming dice having six sides, each side is assigned a different point valve from one to six. (see FIG. 4) A second token 16 is used by the player to keep score.

All players begin from the "bench" 20 (see FIG. 1). In the preferred embodiment, up to five players or teams may play. Before play, a pre-game roll-off is conducted, the player receiving the highest combined point total from the throw of the dice goes first. Play then proceeds in a clockwise direction around the board.

The player throws the pair of dice 18 and advances his/her token 16 according to his/her choice of the number rolled on either die. As illustrated in FIG. 1, the majority of playing squares 14 are one, two or three point scoring squares 21, 22 or 23 respectively. This manner of scoring is directly analogous to one point "free throws" and two and three point "field goals" as found in the game of basketball. Each different scoring square 21, 22, 23 is assigned a distinguishing color. The one point squares 21 being red; two point squares 22 being green; and the three point squares 23 being yellow. This manner of scoring is directly analogous to one point "free throws" and two and three point "field goals" as found in the game of basketball. As further shown in FIG. 1, the set of playing squares 14 includes various miscellaneous squares such as offensive foul 24, turnover 26, return to bench 28, free throw 30, technical foul 32 and player's choice 34. The above miscellaneous squares correspond to penalties or miscellaneous scoring opportunities as found in real basketball, advantageously adding an element of realism to play.

Figure 5:
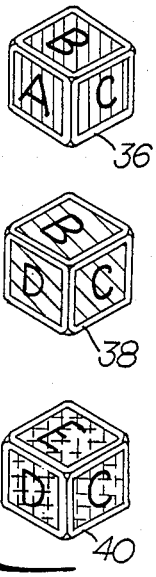
FIG. 5 is a perspective view showing the three question cubes used in the present invention.

Each scoring square 21, 22 and 23 additionally has associated with it a corresponding color-coded question cube 36, 38 and 40, respectively (see FIG. 5). Throwing the appropriate question cube 36, 38 or 40 determines by chance which question among several printed on question card 42 the player must answer correctly in order to "make a basket" (receive points for correctly answering a question).

The precise nature of the questions on question card 42 does not form a part of the present invention. Any manner of questions relating to basketball such as dates, teams, team members, records, etc. can be used.

Figure 3A:
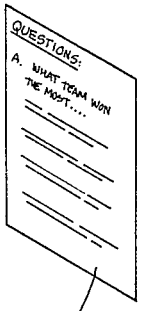
FIG. 3A shows the reverse or answer side of the card of FIG. 3.
Figure 3B:
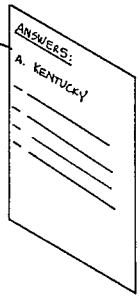
FIG. 3 shows the front side of a trivia question card.

In the preferred embodiment, the front side of question card 42 contains five questions of increasing difficulty denoted A–E. The reverse side of card 42 has answers to the above questions A–E printed thereon. (see FIG. 3) The five questions on question card 42 are sub-divided into three difficulty ranges directly corresponding to one, two and three point scoring opportunities. The easy range, corresponding to the one point squares 21, includes questions A, B and C. The sides of question cube 36 (which corresponds to one point square 21) are marked as follows: A, A, B, B, C and T/O.

The intermediate difficulty range, corresponding to the two point squares 22 includes questions B, C and D. The sides of the corresponding question cube 38 are marked as follows: C, C, C, B, D, T/O.

The difficult question range includes questions C, D and E and corresponds to the three point squares 23. The sides of corresponding question cube 40 are marked as follows: C, D, D, E, E, T/O.

The T/O side found on each question cube 36, 38 and 40 indicates a "turnover". The player who rolls this side "turns over the ball" thereby losing his/her chance to score.

Play continues with each player in turn. If a player lands on one of the miscellaneous squares 24, 26, 28, 30, 32 or 34, he/she obeys the instructions printed on that square. For example, if the player "commits" an offensive foul by landing on the offensive foul square 24, every player in the game except the player who "commited" the offensive foul is given a "free throw". (chance to answer a one point question)

If the player lands on turnover square 26, he/she loses a turn. Similarly, if the player lands on "return to bench" square 28, the player is obliged to return to the bench, forfeiting any scoring opportunity during that turn.

The player who lands on free throw square 30, technical foul square 32 or player's choice square 34 is given an opportunity to score additional points. Upon landing on a free throw square 30, the player is given the opportunity to answer two one point questions. The first question must be correctly answered before the second question can be attempted. Upon landing on a technical foul square 32, the player has had a technical foul commited against him/her and therefore receives two free throws and an extra turn. If the player lands on player's choice square 34, the player has the choice of answering a one, two or three point question.

Score is kept within scorekeeping section 44 which in the preferred embodiment is placed in the center of the board 12. Scorekeeping section 44 includes five sets (one for each player) of 30 consecutively numbered spaces, preferably basketballs in concentric circles. Upon correctly answering the question, the player places his/her second token 16 over the basketball corresponding to the total number of points earned. In this fashion, the total number of points and the relative standings among players are readily ascertainable.

In summary, numerous benefits have been described which result from employing the concepts of the present invention. In particular, the sports trivia board game 10 combines the testing of a player's trivia knowledge with the scoring attributes and play of a basketball game thereby realistically simulating a real life game. The player can score one, two or three points for correctly answering a question, just like the scoring in a real basketball game. The player can also "commit" turnovers and fouls, just like as in real play.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A board game apparatus for testing a player's sports trivia knowledge, comprising:

a plurality of player tokens;

a game board including a plurality of playing spaces, said spaces defining a continous path for advancing said tokens; said spaces including indicia to instruct the player;

random generating means for determining by chance the number of spaces to advance said tokens;

a plurality of question cards having a number of trivia questions printed thereon; and chance means corresponding to the indicia on said spaces said chance means further including second indicia corresponding to the trivia questions on each question card to determine which said trivia question the player is to answer;

whereby, during play the player advances his token a number of spaces indicated by said random number generating means, determines the question to be answered by utilizing the chance means corresponding to the particular indicia in the space upon which the token rests and answers the question scoring a number of points for a correct answer.

2. The board game apparatus of claim 1, wherein the sport of the game is basketball, the playing spaces including indicia corresponding to scoring in the game of basketball.

3. The board game apparatus of claim 1, wherein the indicia on certain of the playing spaces depict actual scoring in real basketball game including one point for a free throw and two/three points for field goals.

4. The board game apparatus of claim 1, wherein other indicia on certain of the spaces depict fouls or the like corresponding to the game of basketball.

5. The board game apparatus of claim 1, said indicia on said spaces including identifying colors and a number corresponding to the points awarded for a correct answer.

6. The board game apparatus of claim 1, further including other indicia on certain of the spaces having instructions regarding basketball action of return to bench, technical foul or the like.

7. The board game apparatus of claim 1, wherein said random number generator comprises at least one die.

8. The board game apparatus of claim 1, wherein said chance means comprises at least one die having reference characters thereon identifying said trivia questions.

9. The board game apparatus of claim 1, wherein said question cards include a front side having said trivia questions printed thereon, and answers corresponding to said questions being printed on said reverse side.

10. The board game apparatus of claim 1, wherein scorekeeping means is provided on the board including a series of concentric circles with spaces signifying the score, each player being assigned a circle to designate the score by placement of a player token.

11. A sports trivia board game apparatus, comprising:

a plurality of player tokens;

a game board including a plurality of playing spaces, said spaces defining a continuous path for advancing said tokens; said spaces including indicia to instruct the players; each of said spaces being colored with an identifying color;

random number generating means for determining by chance the number of spaces to advance said tokens;

a plurality of question cards having a number of trivia questions printed thereon; and chance means having second indicia corresponding to the trivia questions on each question card to determine which said trivia question the player is to answer; said chance means including a plurality of dice, each of said dice uniformly colored with an identifying color corresponding to said different colored spaces;

whereby during play the player advances his token a number of spaces indicated by said random number generating means and answers the question determined by said chance means, scoring a number of points for a correct answer.

12. A basketball sports trivia board game apparatus comprising:

a plurality of player tokens;

a game board including a plurality of playing spaces; said spaces defining a continuous path for advancing said tokens; said spaces including indicia to instruct the player; said indicia corresponding to scoring in the game of basketball, said scoring indicia including identifying colors and a number corresponding to points awarded for a correct answer;

random number generating means for determining by chance the number of spaces to advance said tokens;

a plurality of question cards having a number of trivia questions printed thereon; and chance means having indicia corresponding to the trivia questions on each question card to determine which said trivia question the player is to answer, said chance means further having a color corresponding to the identifying color of said scoring indicia;

whereby during play the player advances his token a number of spaces indicated by said random number generating means and answers the question determined by said chance means, scoring a number of points for a correct answer.

* * * * *